United States Patent [19]

Greiller

[11] 3,968,772

[45] July 13, 1976

[54] CURTAIN COATING APPARATUS

[75] Inventor: Jack F. Greiller, Ruislip, England

[73] Assignee: Eastman Kodak Company, Rochester, N.Y.

[22] Filed: Sept. 28, 1973

[21] Appl. No.: 401,786

Related U.S. Application Data

[60] Continuation of Ser. No. 148,886, June 1, 1971, abandoned, which is a division of Ser. No. 883,185, Dec. 8, 1969, Pat. No. 3,632,403.

[30] Foreign Application Priority Data

Mar. 26, 1969 United Kingdom ..... 15870

[52] U.S. Cl. ..... 118/325; 118/DIG. 4

[51] Int. Cl.[2] ..... B05C 5.00

[58] Field of Search ..... 118/324, DIG. 4, 24, 118/325; 117/105.3; 53/140; 427/420

[56] References Cited

UNITED STATES PATENTS

| | | | |
|---|---|---|---|
| 2,322,827 | 6/1943 | Carver | 118/413 X |
| 3,205,089 | 9/1965 | Kinzelman | 118/DIG. 4 |
| 3,271,184 | 9/1966 | Poletika et al. | 118/DIG. 4 |
| 3,303,816 | 2/1967 | Lauring | 118/DIG. 4 |
| 3,365,325 | 1/1968 | Fraenkel et al. | 118/DIG. 4 |
| 3,508,947 | 4/1970 | Hughes | 118/DIG. 4 |

FOREIGN PATENTS OR APPLICATIONS

| | | | |
|---|---|---|---|
| 908,653 | 10/1962 | United Kingdom | 118/DIG. 4 |

*Primary Examiner*—John P. McIntosh
*Attorney, Agent, or Firm*—Alfred P. Lorenzo

[57] ABSTRACT

In a method of coating a support with a liquid coating composition in which the coating composition is applied by impingement of a free-falling curtain of coating composition onto the surface of the moving support, formation of edge beads along the edges of the coating which are of greater thickness than the remainder of the coating is effectively avoided by use of laterally adjustable edge guides which are initially positioned so as to establish a stable free-falling curtain and then moved laterally to a position in which they are slightly further apart, whereby the coating assumes a uniform thickness. Apparatus for effecting this improvement in the coating process includes clamping means for holding the edge guides in a vertical position and means for effecting controlled lateral movement of the clamping means. The method and apparatus of this invention are useful in both single layer and multiple layer curtain coating and are especially advantageous in the manufacture of photographic film and photographic paper in view of the need for precisely uniform thickness over the entire coated area.

5 Claims, 12 Drawing Figures

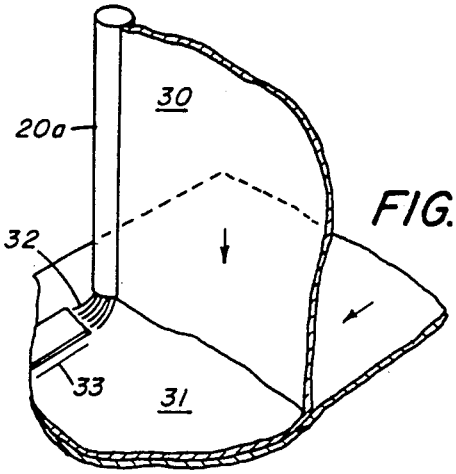
FIG. 1
FIG. 2
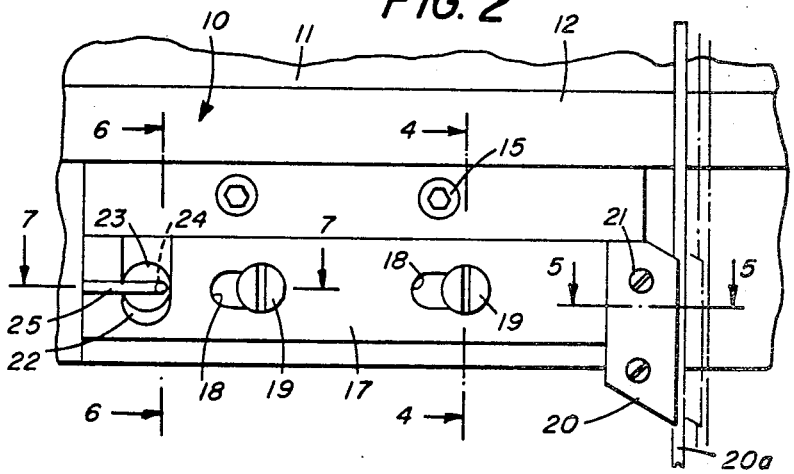
FIG. 3
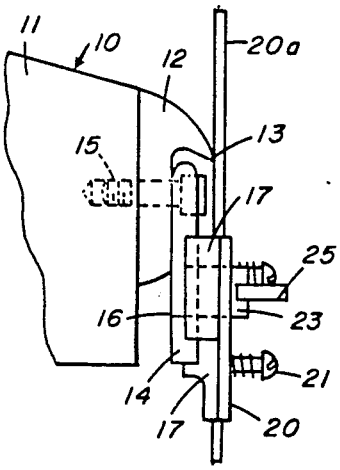
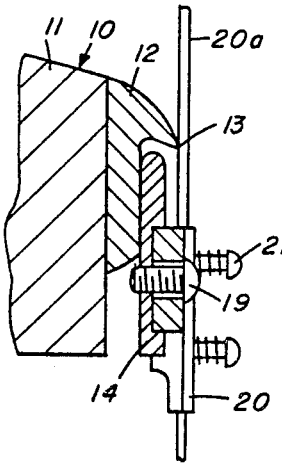
FIG. 4

CURTAIN COATING APPARATUS

This is a continuation of application Ser. No. 148,886 filed June 1, 1971 and now abandoned which, in turn, is a division of application Ser. No. 883,185 filed Dec. 8, 1969 and issued Jan. 4, 1972 as U.S. Pat. No. 3,632,403.

This invention relates to apparatus in which one or more layers of coating composition are applied to a moving support by impingement of a free-falling curtain of coating composition onto the surface of the support. More particularly, this invention relates to an improvement apparatus for effecting such coating whereby the formation of edge beads along the edges of the coating which are of greater thickness than the remainder of the coating is substantially eliminated. The improved apparatus is employed with particular advantage in the manufacture of photographic film and photographic paper.

Manufacture of photographic elements by a method which comprises the steps of forming a free-falling curtain of liquid photographic coating composition within a coating zone and directing a support along a path through the coating zone such that the free-falling curtain impinges thereon, while maintaining a controlled relation between the flow rate of coating composition and the speed at which the support is moved, is disclosed and claimed in copending United States patent application Ser. No. 733,944, now U.S. Pat. No. 3,632,374 entitled "Method And Apparatus For Production Of Photographic Elements", filed in the name of Jack F. Greiller on June 3, 1968, and assigned to the same assignee as the present application. The formation of a coating, in the manufacture of photographic elements or other coated articles, which is comprised of a plurality of distinct superposed layers by forming a stable multilayer free-falling curtain and impinging the curtain onto a moving support is disclosed and claimed in copending United States patent applicaton Ser. No. 733,971, now U.S. Pat. No. 3,508,947 entitled "Method And Apparatus For Simultaneously Applying A Plurality Of Coated Layers", filed in the name of Donald J. Hughes on June 3, 1968, and assigned to the same assignee as the present application. The method and apparatus of this invention represent a useful improvement which may be advantageously utilized in either of the coating methods described in the aforesaid patent application and the disclosure of each of these patent applications is incorporated herein by reference for purposes of indicating the background of the present invention and illustrating the state of the art.

In a particular embodiment of the methods disclosed in the aforesaid copending patent applications, the coating composition is applied to a support material which is in the form of a continuous web and the coating apparatus is provided with edge guides which are equipped with flexible extensions which bear on the surface of the moving web. The edge guides serve to guide the free-falling curtain along its longitudinal edges to define its width at impingement onto the face of the support. One problem encountered in this method of coating is the tendency to formation of edge beads (also referred to hereinafter in some instances as "marginal beads") along each edge of the coating which are significantly thicker than the remainder of the coating.

For example, there is shown in FIG. 1 of the accompanying drawings a fragmentary view of a curtain coating apparatus wherein a curtain 30 of liquid coating composition is shown falling between edge guides 20*a* (only one of which is shown) onto a moving web 31 to be coated. At their lower ends, the edge guides 20*a* have extending therefrom brushes 32. Each brush 32 bears upon the surface of the web 31 at a margin thereof, and can spread out into a "fan tail", as shown. Additionally, surface tension effects tend to draw the bristles inwardly into the coated region of the web. The result of this is that liquid composition falling between the edge guide and the inner trailing edge of the fan tail is swept in by the brush 32 to form a marginal bead 33 containing excess material. This is disadvantageous in that extended drying time is necessary to ensure complete drying of the coated web. Appropriate shaping of the brush bristles partially overcomes the aforesaid disadvantage.

It is an object of the present invention to overcome the aforesaid disadvantage in another way by providing an improved apparatus for curtain coating in which the coating deposited has substantially no excess thickness which would necessitate extended drying at any point transversely of the support material.

According to the present invention, there is provided an apparatus for coating a liquid composition on a support material which comprises the steps of establishing a stable, free-falling curtain of a coating composition between edge guides, of a desired uniform flow rate except at the edge guides, moving a support to be coated through the curtain in a direction transversely thereof, and then moving the edge guides apart to a position at which the coating assumes a uniform thickness. For optimum results, each of the edge guides is moved away from the other by a distance substantially equal to the cross-sectional area of the excess coating composition in the adjacent edge bead divided by the thickness of the coating.

Preferably, the edge guides are moved apart a greater distance than the aforesaid distance and are then moved together to the aforesaid distance.

In a preferred apparatus of the invention, the edge guides each comprise a rod, which rods are spaced apart a distance such that they are each in line with a respective margin of the support to be coated. The rods terminate at their lower ends only a short distance from the surface of the support, e.g. 0.3 to 0.6 centimeters. From the lower ends of the rods extend flexible members which bear on the surface of the support. The flexible members may comprise a piece of flexible tape or a plurality of bristles forming a brush.

Advantageously, the edge guides may be mounted on sliding members, by any suitable means such as clamps. The sliding members are arranged to slide in a direction such that the edge guides are moved in the plane of the curtain. Preferably, the member is in the form of a plate having one or more apertures through which extend bolts. The bolts are attached to a backing plate. The bolts serve by friction to prevent unintentional movement of the sliding plates.

The movement of the sliding plates is conveniently effected by eccentric cams each of which may be located in a slot in a respective one of the sliding plates. Conveniently, the cam is cylindrical and has an eccentrically positioned pin. Advantageously, the cam is manually rotatable by means of a key attached to that end of a cam remote from the pin. The cam facilitates fine adjustment of the sliding plate by an operator.

In the establishment of the curtain, means are preferably provided for restricting the width of the flow to the desired curtain width. Thus, in a preferred embodiment of the invention, the coating composition issues from a slot or slots and flows down an inclined surface terminating in a lip with which the edge guides are in contact at their upper ends. The width of the flow across the inclined surface is restricted by any suitable means such as pieces of adhesive tape. The inner margins of the tapes are in line with the inner margins of their respective edge guides at the slot but are cut back across the inclined surface and are in line with the outer margins of the edge guides at the lip.

The present invention also provides a curtain coating apparatus comprising curtain forming means mounted at a coating station, movable edge guides arranged so as to be substantially coplanar with a curtain to be formed, for defining the width of the curtain, and wherein are provided means for moving the edge guides apart and means for subsequently moving the edge guides together a lesser distance.

Preferably, the same means serves for moving the edge guides apart and together.

Further, the edge guides preferably comprise rods having flexible members extending from that end thereof which, in use, is lowermost. The flexible members may comprise a piece of tape or a plurality of bristles forming a brush. The rods are mounted in a position such that the flexible members bear on the outer margins of a support material to be coated.

Preferably, the edge guides are each mounted on a respective sliding member, such as a plate. The edge guides may be mounted on the plates by means such as clamps.

Conveniently, each sliding plate has elongated apertures and bolts extend through the apertures and are fixed into a respective backing plate. The bolts may carry spring washers to maintain the sliding plate in a desired position on the backing plate.

Advantageously, a respective eccentric cam is located in a slot in each sliding plate. The cam is preferably of a cylindrical shape and rotatably mounted by means of an eccentric pin located in an aperture in the respective backing plate. A key may be provided to facilitate manual operaton of the cam.

The invention will now be described further with reference to the remaining figures of the accompanying drawings, in which:

FIG. 1 is a fragmentary view of a curtain coating apparatus in which an edge guide controls the edge of the curtain.

FIG. 2 is a front elevation of one end of a curtain coating apparatus according to the present invention;

FIG. 3 is a side elevation of the apparatus shown in FIG. 2;

FIG. 4 is a vertical section taken along the line 4—4 of FIG. 2;

Figure 5:
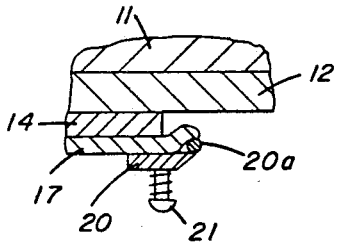
FIG. 5 is a horizontal section taken along the line 5—5 of FIG. 2.

In FIGS. 2 to 7 of the drawings, there is shown one end of a curtain coating apparatus 10 comprising an inclined surface 11 having a curved extension 12 thereto. The curved extension 12 terminates in an undercut lip 13. Attached by means of screws 15 to the curved extension 12 beneath the lip 13 is a backing plate 14. The backing plate 14 is formed with a recess 16 which extends along the whole length thereof parallel to its longitudinal edges. An elongated sliding plate 17 is located in the recess 16. The sliding plate 17 has apertures 18, which are elongated in a direction parallel to the elongation of the plate 17. Bolts 19 are located in the apertures 18 and are screwed into the backing plate 14. A clamp 20 is mounted at one end of the plate 17 and is attached thereto by means of spring urged bolts 21. The plate 17 is shaped so as to allow an edge guide, such as a rod **20*a* to be clamped between it and the clamp 20. As can be seen in FIG. 2, the upper and lower edges of the clamp 20 and of the plate 17 are arranged so that, in use, they slope downwardly towards the edge guide 20*a*. This construction serves to prevent liquid coating composition from flowing along such edges of the clamp 20 and the plate 17. As shown in FIGS. 2 and 3, an edge guide rod 20*a* is clamped between the plate 17 and the clamp 20 in a position such that it touches the lip 13**.

Adjacent the end thereof remote from the clamp 20, the plate 17 is formed with a U-shaped alot 22. Located in the slot 22 is an eccentric cam 23. The cam 23 is cylindrical and is rotatably mounted by means of an eccentrically located pin 24. The pin 24 locates in an aperture in the backing plate 14. A handle 25 is attached to the exposed end of the pin 24.

FIG. 4 shows the relationship of the backing plate 14, the recess 16 and the bolts 19.

FIG. 5 shows the relationship of the plate 17 and the clamp 20.

Figure 6:
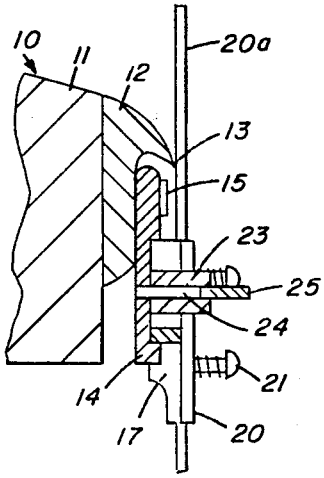
FIG. 6 is a vertical section taken along the line 6—6 of FIG. 2.

FIG. 6 shows the relationship of the backing plate 14, the plate 17 and the cam 23.

Figure 7:
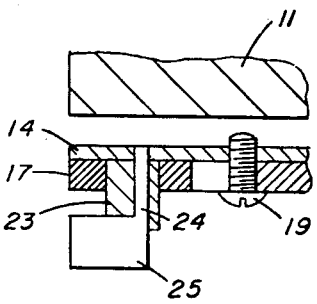
FIG. 7 is a horizontal section taken along the line 7—7 of FIG. 2.

FIG. 7 further illustrates the relationship of the plate 17 and the cam 23.

Figure 8:
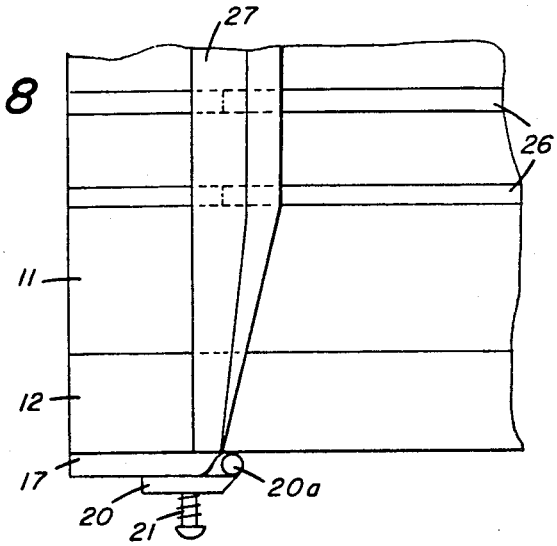
FIG. 8 is a partial plan view of the apparatus shown in FIG. 2.

FIG. 8 is a partial plan view of the apparatus shown in FIG. 2 and illustrates the relationship between the inclined surface 11 and the curved extension 12 and slots 26 from which the coating composition is exuded. Further, there is also shown a piece of tape 27 which is adapted to restrict the flow width. The tape 27 is formed of a photographically inert material having a high water contact angle. In a preferred embodiment of the invention, the tape is formed of polytetrafluoroethylene (such as the polytetrafluoroethylene sold under the trademark Teflon) and, as shown, is in line with the inner margin of the edge guide rod **20*a* as the slots 26 but, across the inclined surface 11 and the curved extension 12, is cut back to be in line with the outer margin of the edge guide rod 20*a* at the lip 13**.

It will be appreciated that a similar construction of an edge guide and means for mounting the same is provided at the opposite end of the inclined surface 11.

Figure 9:
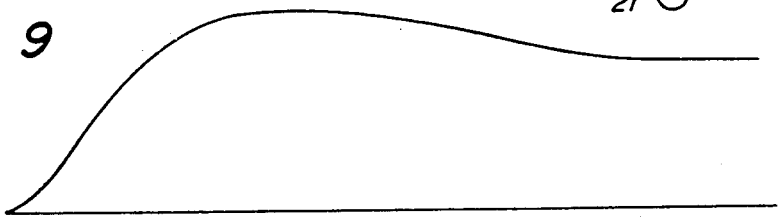
FIG. 9 is a cross-section of a marginal part of a coated layer, to an enlarged scale, showing the coating formed when the edge guides are too close together as described in relation to FIG. 1.

FIG. 9 shows the cross-section of a coating obtained by prior methods, i.e. without the benefit of the improvement in the coating method and apparatus described herein. The coating has a thick edge bead which requires greatly increased drying time compared to the rest of the coating.

Figure 10:
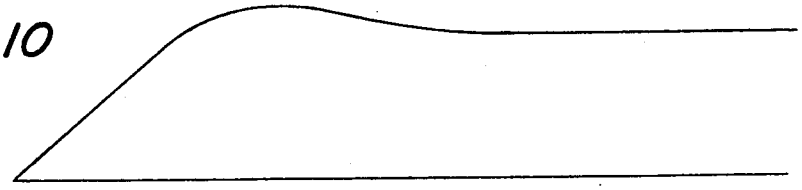
FIG. 10 is a cross-section of a coated layer formed when brushes of the edge guides have been appropriately shaped but still in the position of FIG. 9.

FIG. 10 shows the cross-section of a coating obtained on tapering the brushes of the edge guide but with the edge guide in the same position utilized in forming the coating shown in FIG. 9. The excess coating at the edges has been reduced somewhat so that drying time is reduced but is still excessive.

Figure 11:
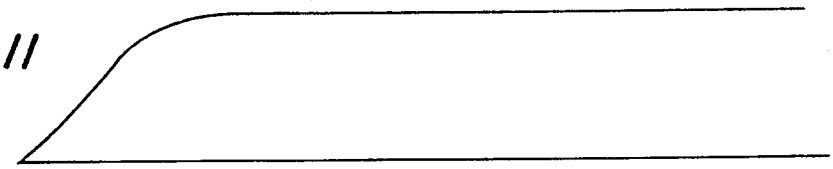
FIG. 11 is a cross-section of a coated layer when the edge guides are moved apart a first extent from the position of FIGS. 9 and 10.

FIG. 11 shows the cross-section of a coating obtained on moving the edge guides apart from the position of FIGS. 9 and 10. The excess coating at the edges has disappeared. There is no drying problem with a coating of this form but there is difficulty in identifying that one has reached this condition by normal non-destructive inspection of the curtain or the coating.

Figure 12:
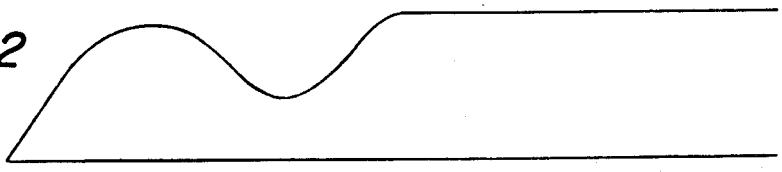
FIG. 12 is a cross-section of a coated layer when the edge guides are moved apart a further extent from the position of FIG. 11.

FIG. 12 shows the cross-section of a coating obtained on moving the edge guides apart from the desired position of FIG. 11. Again there is no excess coating at the margin but a trough has formed which is the result of severe thinning of the curtain just inwardly of the edge guide. This causes great instability in the curtain. Thus, in this position there is no drying problem but a coating problem is encountered. The purpose of moving the guides out to this position and then back is that the state of being just short of severe curtain thinning is the best indication that the coating will have satisfactory edge beads.

In operation, a liquid coating composition is fed from a hopper (not shown) onto the inclined surface 11. From there it flows onto the curved extension 12 and over the lip 13. In this way a free-falling curtain of the coating composition is formed between the edge guides. Simultaneously, a support material to be coated is passed through the curtain in a direction transverse to the plane thereof.

At this stage, however, there is a tendency for a marginal bead of excess material to be formed at the inner trailing margin of the flexible members at the lower ends of the edge guides 20*a* (see FIGS. 1 and 9 or FIGS. 1 and 10). This is because the flexible members sweep out any coating composition falling onto the web in a line between their respective inner trailing ends and their respective edge guides.

Thus, in order to obtain a substantially uniform coating thickness between the trailing ends of the flexible members as indicated in FIG. 11, the edge guides are moved apart a distance substantially equal to the cross-sectional area of the excess coating material in the marginal beads divided by the lay-down thickness of the coating between the beads, by turning the cam 23 by means of the key 25.

In this way, the plates 17 are each moved from the position shown by broken lines in FIG. 2 to the position shown in full lines. At this stage, the curtain becomes such that a uniform coating is produced between the inner trailing margins of the flexible members. Thus, edge beads of greater thickness of coating material which are normally formed on the surface of the support material during coating are minimized or entirely obviated.

As mentioned above, there is no non-destructive method of determining when the stage indicated in FIG. 11 is reached. However, according to a preferred method, if the brushes are moved sideways away from the curtain center, so as to extend the width of the curtain, to a stage where the curtain begins to thin out in a vertical line about one-sixteenth inch in from the edge guide (giving rise to a coating, as indicated in FIG. 12, wherein the marginal portions are not beads but are a lesser thickness than the desired thickness of the coating as a whole) and is then moved back towards the curtain center about one-thirty-second inch, the situation illustrated in FIG. 11 is obtained, i.e. the thinned out portion of the flow disappears, resulting in a curtain of maximum stability, with, at the same time, a minimum of excess flow in the vicinity of the brush. When a support material is coated, this results in an edge bead to the coating on the support which has little, if any, excess coating composition relative to the remainder of the coating, needing no extra drying and causing minimum waste.

It has been found that moving the edge guides together one-thirty-second inch is extremely advantageous but the optimum distance for any particular coating will depend on flow rate, coating thickness and other parameters and can be determined empirically.

The invention has been tested experimentally with curtain widths of 42 inches while coating at speeds in the range from 150 to 250 feet per minute, and good results were obtained in each instance.

The invention has been described in detail with particular reference to preferred embodiments thereof, but it will be understood that variations and modifications can be effected within the spirit and scope of the invention.

I claim:

1. In a curtain-coating apparatus having means for forming a free-falling curtain of liquid coating composition which is directed to impinge on the face of a moving support, a pair of edge guide members each having means defining a vertically oriented edge guide surface, and means for mounting each edge guide member with respect to the curtain forming means such that the edge guide surfaces are adjacent to and vertically aligned with the opposite edges of a formed curtain to engage the edges of said curtain, the improvement wherein said mounting means comprises:

a. support means located in a predetermined position with respect to the curtain forming means;

b. means movably mounting each of said edge guide members on said support means in such manner that each edge guide member is longitudinally stationary but laterally movable so that the vertically oriented edge guide surfaces can be moved laterally in the plane of the curtain; and c. control means for driving each said edge guide member a perdetermined distance laterally between first and second predetermined positions while maintaining the vertical orientation of the respective edge guide surfaces to adjust the width of a stable, free-falling curtain between said edge guide surfaces whereby the thickness of any edge bead formed in the curtain adjacent each edge guide surface is substantially reduced so that the coating assumes a substantially uniform thickness.

2. The invention as claimed in claim 1 further comprising a flexible member extending from each said guide surface defining means, and adapted to bear on the edge portion of the coated surface of the moving support.

3. The invention as claimed in claim 1 wherein each said movable mounting means comprises a plate slidably mounted on said support means for movement of the respective edge guide surface in the plane of an established curtain; and each said control means comprises means defining a slot in said slidable plate, and cam means located in said slot and rotatably and eccentrically mounted for laterally driving the respective edge guide member.

4. The invention as claimed in claim 1 wherein each of said edge guide surface defining means comprises a substantially straight, vertically mounted rod.

5. In a curtain-coating apparatus having means for forming a free-falling curtain of liquid coating composition which is directed to impinge on the face of a moving support, a pair of edge guide members each having means defining a vertically oriented edge guide surface, and means for mounting each edge guide member with respect to the curtain forming means such that the edge guide surfaces are adjacent to and vertically aligned with the opposite edges of a formed curtain to engage the edges of said curtain, the improvement wherein said mounting means comprises:

a. support means located in a predetermined position with respect to the curtain forming means;

b. means movably mounting each of said edge guide members on said support means in such manner that each edge guide member is longitudinally stationary but laterally movable so that the vertically oriented edge guide surfaces can be moved laterally in the plane of the curtain; and c. control means for driving each said edge guide member a predetermined distance laterally between first and second predetermined positions while maintaining the vertical orientation of the respective edge guide surfaces to adjust the width of a stable, free-falling curtain between said edge guide surfaces whereby the thickness of any edge bead formed in the curtain adjacent each edge guide surface is substantially reduced so that the coating assumes a substantially uniform thickness; wherein each said movable mounting means comprises a plate slidably mounted on said support means; each said control means comprises a slot in said slidable plate and cam means located in said slot and rotatably and eccentrically mounted for laterally driving the respective edge guide member; and each said edge guide surface defining means is mounted on one of said slidable plates by a clamp having upper and lower edges that are sloped downwardly toward its respective edge guide surface to prevent liquid coating composition from flowing along such edges of said clamp.

* * * * *